United States Patent [19]

Takimoto et al.

[11] 4,025,340

[45] * May 24, 1977

[54] PROCESS FOR TONING ELECTROPHOTOGRAPHIC PHOTOSENSITIVE MATERIAL

[75] Inventors: Masaaki Takimoto; Satoru Honjo, both of Asaka, Japan

[73] Assignee: Fuji Photo Film Co., Ltd., Kanagawa, Japan

[ * ] Notice: The portion of the term of this patent subsequent to Feb. 18, 1992, has been disclaimed.

[22] Filed: Nov. 10, 1971

[21] Appl. No.: 197,493

[52] U.S. Cl. ..... 96/1.6; 96/1 R; 96/1.7

[51] Int. Cl.[2] ..... G03G 5/09

[58] Field of Search ..... 96/1 R, 1.6, 1.7, 53; 8/111

[56] References Cited

UNITED STATES PATENTS

| | | | |
|---|---|---|---|
| 2,005,448 | 6/1935 | Aisen | 8/111 X |
| 2,020,775 | 11/1935 | Gaspar | 96/53 |
| 3,250,614 | 5/1966 | Eastman | 96/1 R |
| 3,381,596 | 5/1968 | Bresina et al. | 96/1 R |
| 3,418,115 | 12/1968 | Menold et al. | 96/1 R |
| 3,488,705 | 1/1970 | Fox et al. | 96/1.6 |
| 3,585,026 | 6/1971 | Rees | 96/1 R |
| 3,627,527 | 12/1971 | Gilman et al. | 96/1.6 |
| 3,630,733 | 12/1971 | Manhardt | 96/1.7 X |
| 3,671,233 | 6/1972 | Contois | 96/1.5 |
| 3,867,138 | 2/1975 | Takimoto et al. | 96/1 R |

*Primary Examiner*—Edward C. Kimlin
*Assistant Examiner*—Judson R. Hightower
*Attorney, Agent, or Firm*—Gerald J. Ferguson, Jr.; Joseph J. Baker

[57] ABSTRACT

Toning an electrophotographic layer by adding materials which bleach at different rates, and thereafter selectively bleaching the materials after development.

7 Claims, No Drawings

PROCESS FOR TONING ELECTROPHOTOGRAPHIC PHOTOSENSITIVE MATERIAL

BACKGROUND OF THE INVENTION

1. Field of the Invention

This invention relates to a process for toning a colored electrophotographic photosensitive layer after a developing treatment.

2. Description of the Prior Art

It is known that an electrophotographic photosensitive layer can be produced by dispersing a photoconductive powdered material into a resinous binder, and for this purpose various photoconductive materials are already known to be usuable such as cadmium sulfide, zinc oxide, zinc sulfide etc. Though the color of the electrophotographic photosensitive layer is not an important factor in electrophotographic processes containing the step of transferring a toner image onto an ordinary paper sheet, the color significantly affects the image final quality obtained if the process does not contain such transfer step. In the case of using such a photoconductive powdered material, however, spectral sensitizing dyes are frequently added in order to correct the spectral sensitivity thereof or to improve the sensitivity thereof.

Consequently, it has been necessary to prepare a photosensitive layer making a compromise between the final image quality and the spectral sensitivity of such layer. To spectrally sensitize photoconductive powdered materials various dyes are known, e.g., the xanthene dyes, triphenyl methane dyes, azo dyes, cyanine dyes, merocyanine dyes, etc.

Such spectral sensitizing dyes show fading at different rates when an electrophotographic photosensitive layer containing the same is exposed to light. Consequently, if the color of a photosensivite layer is selected to compromise with spectral sensitivity directly after developing, discoloration or fading of the photosensitive layer after a period of time may result in a disagreeable color. However, in the case of storing an unused electrophotographic photosensitive layer in a dark place, it is possible to obtain a fairly long shelf-like even when such elements are sensitized with cyanine dyes, which generally show very poor stability against light. This long shelf life often leads to a careless selection of sensitizing dyes without giving consideration to the light fastness thereof, and it is often impossible to maintain final image quality at a constant level for a prolonged period. In order to prevent this drawback it has been proposed to remove the sensitizing dye from the electrophotographic photosensitive layer after the developing treatment thereof, such as by a bleaching bath consisting of a solution of an organic acid (U.S. Pat. No. 3,250,614). The composition of such a bleaching bath, however, must leave the photosensitive layer and the image intact, and therefore severe restrictions are placed upon the bleaching bath, depending upon the pigment used as the toner and the resin component employed in the developer.

SUMMARY OF THE INVENTION

The present invention provides a process for toning electrophotographic photosensitive layers which comprise a photoconductive powdered material and a resinous binder which comprises adding a specific dye or specific dye and pigment thereto and selectively bleaching said dye or said dye and pigment after the developing treatment. Any liquid developer containing toner which does not discolor in the processing solution on toning after treatment is operable. Such are as disclosed in U.S. Pat. Nos. 2,907,674; 3,081,263; 3,058,914; 3,198,649; 3,259,581; 3,337,340.

DETAILED DESCRIPTION OF THE INVENTION

There is no limitation on the photoconductive powdered material used in this invention and common materials such as zinc oxide, zinc sulfide, cadmium sulfide, titanium dioxide, indium trioxide, anthracene, etc. are easily used.

Further, any resinous binder which does not affect the photoconductive powder may be used such as, silicone resins, alkyd resins, polyvinyl chloride, polyvinyl acetate, vinyl chloride-vinyl acetate copolymers, polystyrene, polyalkyl methacrylate, polyalkylacrylate, stryrene-butadiene copolymer epoxy resin, epoxy ester resins, etc.

Selective bleaching of a coloring material contained in an electrophotographic photosensitive layer after developing, which is an essential step of the process according to this invention, can be conveniently carried out by exposure to strong light irradiation, particularly ultraviolet irradiation, by a acidic or alkaline bleaching bath, or by chemical treatment with substances containing peroxides. The bleaching step may simultaneously, perform other functions such as washing, drying, fixing the electrophotographic photosensitive layer to hold a reproduced image thereon, or forming a surface protective layer on the layer in addition to the bleaching operation.

It has already been proposed to apply a transparent lacquer on the surface of an electrophotographic photosensitive layer holding a reproduced image thereon in order to fix the image and simultaneously form a surface protective layer, and the objects of the present invention can be simply realized by adding a small amount of peroxide to such a transparent lacquer. In this case it is naturally necessary to add coloring materials capable of being easily bleached by such a peroxide in the lacquer and coloring materials relatively stable against the peroxide in a suitable ratio into said electrophotographic photosensitive layer at the preparation thereof.

Fixing and surface protection of an image can also be achieved by laminating a transparent film on to the surface of an electrophotographic photosensitive layer after developing, and a similar effect to that described above is obtained if a peroxide is added to the adhesive material employed for the lamination.

U.S. Pat. No. 3,250,614 discloses decoloring the sensitizing dye in a photoconductive layer using an organic acid.

On the other hand, this invention relates to toning method of decolorizing the easily decolorized dye using peroxide, utilizing the difference of the decoloration degree of the sensitizing dyes, following by decoloration with light, if desired. Accordingly, it is necessary to select the sensitizing dyes for effecting the above purpose.

Electrophotographic photosensitive layers generally employed in the reproduction area are adjusted to a neutral color by means of sensitizing dyes or by toning agents, and is generally preferred to have, after developing, a bluish or greenish color rather than a yellowish or pinkish color. Consequently, it is desirable to incorporate into the photosensitive layer a yellow or pink coloring material with relatively low stability against light or chemicals and blue or green coloring materials with a relatively high stability. In spite of such a general tendency, however, it is possible to bleach any color selectively by the correct choice of coloring materials of suitable stability to be added in the electrophotographic photosensitive layer, for example, in order to meet personal taste or to classify images by the color of the subject or the background.

Any electrophotographic photosensitive layer containing a coloring material may be employed in the present invention. It is desirable, however, to clarify the purpose of addition of each coloring material. For instance, cyanine or merocyanine dyes can be subjected to toning according to the present invention because of their relatively low light fastness or relatively low stability against peroxides (in comparison with xanthene or azo dyes). In greater detail an electrophotographic photosensitive layer can be prepared in a neutral color by regulating the amounts of fluorescein and rose bengal (xanthene dyes) and brilliant blue FCF (triphenylmethane dye). Such a photosensitive layer can have further added thereto a cyanine dye in order to improve the spectral sensitivity, and a transparent lacquer containing a peroxide can be applied after developing to fix the reproduced image and to protect the surface of the layer. Successive exposure to light cause selective bleaching of the cyanin dye to provide a reproduction with a background of nearly neutral color which provides increased brightness after prolonged exposure to light.

For certain purposes a photosensitive layer is provided with almost equal sensitivity to blue, green and red light. In such a case it is necessary to increase the sensitivity of the layer to the blue and green wavelength regions when a tungsten lamp is to be used as the exposure light source, and such modification inevitably results in a reddish color in the layer. This red coloration can be compensated for by adding a dye and/or pigment which is capable of absorbing red light but incapable of spectral sensitization in the electrophotographic process, but such addition not only significantly lowers the brightness of the photosensitive layer but also the efficiency of the sensitizing dye in the red wavelength region. According to the present invention, on the other hand, the above drawback is removed by employing sensitizing dyes of distinctly different fading rates for the red region and the blue-green regions and also by employing dyes for the latter regions in relatively large amounts. More specifically, the purposes of this invention can be realized by using cyanine or merocyanine dyes for sensitization in the blue and green regions and relatively stable phthalocyanine dyes for the red regions accompanied by selective fading by, e.g., applying an acrylic lacquer containing a peroxide for surface protection. Cyanine and merocyanine are stable provided they are stored in the dark, because they are relatively quickly decolored when exposed to light and given a decoloring treatment. When they are used they give a desired spectral density.

A further problem encountered with photoconductive elements is that the resinous binder in the electrophotographic photosensitive layer may turn yellow due to photocatalytic activity of zinc oxide, etc., employed as the photoconductive material. Such a drawback should naturally be suppressed by improving the resin itself, but, according to this invention, it is possible to maintain the background at a constant neutral color by previously adding a phthalocyanine dye to said photosensitive layer in combination with other coloring materials. Although the bleaching step according to this invention can be accomplished by various methods as mentioned above, the use of a transparent lacquer containing a peroxide or a transparent laminate film containing a peroxide in the adhesive material therefor has marked advantages as explained above, enabling fixing and protection of the image to be obtained at the same time.

An example of such a transparent lacquer is, for example, as follows:

Styrene-butyl methacrylate copolymer (50:50 molar rato; polymerization degree about 200)—2parts by weight Daiflon S-2-($CCl_2F$-$CCl_2F$, Daikin Kogyo Co., Ltd.) — 40 parts by weight Cyclohexane — 40 parts by weight Mineral spirit — 15 parts by weight n-butyl acetate — 5 parts by weight.

Since a styrene-butyl methacrylate copolymer usually contains benzoyl peroxide in an amount of about 0.1% as a polymerization initiator, the transparent lacquer thus obtained will usually contain residual peroxide in an amount of about 0.01%. It is desirable to positively add benzoyl peroxide to said transparent lacquer since peroxides play an important role in the process of this invention. In case of using an acrylic resin obtained by employing azobisisobutyronitrile as a polymerization initiator, similar results can be reached by adding small amounts of benzoyl peroxide or other organic peroxides to the transparent lacquer. Benzoyl peroxide functions as a polymerization initiator for acrylic resins, and possesses a strong destruction power toward the pigment.

Azobisisobutyronitrile functions as a polymerization initiator for acrylic resin and has a strong destructive power which is not as strong as benzoyl peroxide. It is well-known that this compound is decomposed by ultra-violet ray irradiation and liberates peroxide.

As transparent lacquers, those that are colorless and extremely pale are preferred and any clear lacquer commonly used for coating is operable. Clear lacquer comprising nitrocellulose, resin and solvent is an example of such. Acrylic resins are often used. Toning agent of the pigment used as a toner may melt away depending upon the solvent used. The lacquer of the present invention preferably includes a peroxide.

The adhesive material used for laminating transparent film can be composed, for example, of materials as are desclosed in U.S. Pat. No. 3,381,596:

| | | |
|---|---|---|
| Ethyl acrylate | 55 parts by weight | terpolymer |
| N-vinyl-2-pyrrolidone | 20 parts by weight | |
| N-tert-butylacrylamide | 25 parts by weight | 90 parts by weight |

Low molecular weight epoxy resin(bisphenol-A-epichlorohydrine) condensate ERL 2774 (manufactured by Union Carbide Corp.) has a m.w. of about 400, Epikoto 828 (manufactured by Shell Oil Co.) has a m.w. of about 370 and may also be used. 9.9 parts by weight Citric acid — 01. parts by weight Peroxide — 0.08 parts by weight.

As the adhesive, colorless or pale adhesives which do not damage the toner image may be operable, such polyvinyl acetate, polyethylacrylate, vinyl acetate-ethylacrylate copolymer, vinylacetate-ethylene copolymer, polyethylhexylmethylacrylate, aliphatic polyester, xylene-formaldehyde resin, natural rubber, rosin, hydrogenated rosin etc.

U.S. Pat. No. 3,381,596 also discloses examples of peroxides employable in this formulation, and particularly suitable peroxides are hydroperoxide, hydrogen peroxide, tert-butyl hydroperoxide, cumene hydroperoxide, 2,5-dimethylhexyl-2,5-dihydroperoxide, p-methane hydroperoxide, etc.

The adhesive material for laminating such a film can be of the semi-liquid type at room temperature or of the heat-sensitive type which is solid at room temperature. An efficient laminating method consists of laminating a plastic film provided with an adhesive material layer which is solid at room temperature but which is soluble in a non-polar liquid or the like employed in the liquid developing process. The film can be applied when the photosensitive layer is still wet with the non-polar liquid after developing with a liquid developer. The objects of this invention can be realized, of cause, by adding a small amount of organic peroxide to said adhesive material layer.

The material comprising the reproduced image is, of course, required to be stable against the reagent (for example an organic peroxide, etc.) which is used to decompose the sensitizing dyes. Most organic and inorganic pigments, including carbon black, remain intact in the presence of a small amount of such peroxides and can therefore be satisfactorily employed in the process of this invention. Pigments excessively susceptible to decomposition, e.g., oxidation will be easily determined by one skilled in the act.

The amount of organic peroxide in the adhesive layer provided on the plastic film or in the transparent lacquer can be within the range of 0.0001 – 0.1 gr/m² of the photosensitive layer, more preferably 0.0001 – 0.01 gr/m². An excessive amount does not lead to any additional advantage. The peroxide is believed to perform a catalytic action, and is frequently capable of decomposing dyes in excess of its chemically equivalent amount.

This invention will now be further clarified by the following examples.

EXAMPLE 1

100 parts by weight of zinc oxide, 12 parts by weight of styrenated alkyd resin (Japan Reichhold; Styresol No. 4400), 8 parts by weight of polyisocyanate (Bayer; Desmodur L; 50% xylylene solution, acid value of below 8) as the hardner and 80 parts by weight of n-butyl acetate were mixed and blended in a porcelain ball mill for 15 hours to obtain a white suspension. The white suspension thus prepared was subjected to a sensitizing treatment consisting of the addition of one of the following three dye solution followed by mixing a homogenizer. The product was then coated to obtain a dried coating thickness of 10 microns on a support material consisiting of art paper previously subjected to surface treatment with colloidal alumina (Nissan Chemical: Alumina Sol No. 100). After drying, the coated paper was placed in a thermostatic box at 50° C for 12 hours to harden the resinous binder:

Sample A

White suspension without dye addition.

Sample B

Suspension had added 4 mg of fluorescein, 4 mg of rose bengal, 2 mg of bromochlorophenol blue and 3 mg of 3,3′-di-β-carboxyethylthiadicarbocyanine bromide dissolved in 10 ml of methanol (per 100 gr of zinc oxide).

Sample C

Suspension had added 3 mg of fluorescein, 3 mg of rose bengal and 4 mg of brilliant blue FCF (C.I. 42090) dissolved in 10 ml of methanol (per 100 gr of zinc oxide).

Sample D

Suspension had added the solution in Sample C further containing 2 mg of 3,3′-di-β-carboxyethylthiadicarbocyanine bromide.

The relative photosensitivity of the above samples under a tungsten lamp (about 3000° K) were:

A : B : C : D = 1: 20: 10: 18.

The photosensitive layers prepared with the above-mentioned samples provided excellent images upon exposure and development with liquid developer containing carbon black toner. Successive fixing and protection with a transparent acrylic lacquer caused a color change in the background area, as shown by the C.I.E. color coordinates in Table 1. The acrylic lacquer employed was a stryene-butyl methacrylate copolymer (50 : 50) and contained about 0.01% of remaining benzoyl peroxide, (with respect to the resin), which was added as the polymerization initiator.

Table 1

| Sample | Coordinate | C.I.E. (1) coordinate of fresh photosensitive layer | C.I.E. (2) coordinate directly after application of lacquer | C.I.E. (3) coordinate after light-exposure for 2h. without lacquer coating | C.I.E. (4) coordinate after light-exposure for 2 h. after coating |
|---|---|---|---|---|---|
| A | x | 0.3099 | 0.3109 | 0.3099 | 0.3125 |
| | y | 0.3175 | 0.3187 | 0.3173 | 0.3205 |
| B | x | 0.3057 | 0.3109 | 0.3075 | 0.3128 |
| | y | 0.3104 | 0.3039 | 0.3118 | 0.3159 |
| C | x | 0.3081 | 0.3074 | 0.3086 | 0.3090 |
| | y | 0.3157 | 0.3183 | 0.3165 | 0.3185 |
| D | x | 0.3032 | 0.3029 | 0.3046 | 0.3091 |
| | y | 0.3123 | 0.3142 | 0.3137 | 0.3161 |

The fading or bleaching accelerated by the lacquer coating is clearly indicated by the difference between 2 and (4) larger than the differences between (1) and (3) in Table 1. Sample B was found to be closest directly after lacquer coating (condition (2)) to the color of standard C light source, as determined by the C.I.E., which is represented by $x = 0.3100$ and $y = 0.3160$. On the other hand, residual color, which was observed in Sample C and Sample D was designed to come closest to the color of standard C light source certain period after lacquer coating (condition (4)). The color of Sample B was found to be distinctly reddish compared with the C light source at condition (4), principally because of rapid decomposition of the 3,3′-di-β-carboxyethylthiadicarbocyanine bromide.

The advantages of this invention are most clearly found in the Sample D, which was designed to show high sensitivity and a residual color very close to that of standard C light source. In this example, in order to improve photosensitivity while retaining satisfactory residual color of Sample C, 3,3'-di-β-carboxyethylthiadicarbocyanine bromide was added to the photosensitive layer and decomposed rapidly after development by means of an acrylic lacquer containing a peroxide.

EXAMPLE 2

The white suspension shown in Example 1 had added thereto the following dye solution (per 100 gr of zinc oxide), sufficiently mixed and coated onto an art paper sheet previously subjected to an electroconductive treatment so as to obtain a dried coating thickness of 10 microns.

Sample E

Fluoroscein — 3.0 mg
Rose Bengal — 3.0 mg
C.I. direct blue 86 (C.I. 74180) — 5.0 mg
Methanol — 10 ml.

(Formula I)

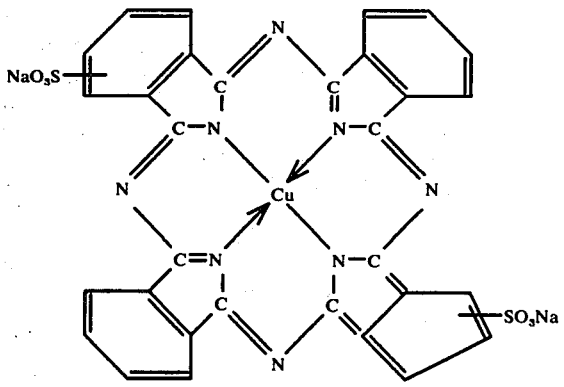

C.I. direct blue 86 (C.I. 74180)

The photosensitive layer thus prepared showed spectral absorptions at 510, 580 and 680 mμand a photosensitivity about 15 times higher than that of sample A in Example 1.

Exposure to light for 2 hours after lacquer coating as in Example 1 significantly reduced the spectral absorption at 510 and 580 mμ, while the absorption at 680 mμremained almost unchanged to provide a somewhat bluish photosensitive layer. This change is attributable to the higher stability of direct blue 86 against peroxides as compared to fluorescein and rose bengal.

After light exposure for 5 hours the only observable spectral absorption was that of the direct blue 86, and the photosensitive layer changed to pale blue.

Example 3

100 parts by weight of zinc oxide, 12 parts by weight of styrenated alkyd resin, 8 parts by weight of polyisocyanate compound condensate of 1 mol trimethylolepropane and 3 mol. tolylene-di-isocyanate as hardener and 80 parts by weight of n-butyl acetate were mixed together with one of the following coloring materials and blended for 16 hours in a porcelain ball mill to obtain suspensions colored pale yellow, pink and blue, respectively.

Sample F — Cadmium sulfide — 0.003 parts by weight
Sample G — Brilliant carmine 6B — 0.003 parts by weight
Sample H — Phthalocyanine blue — 0.003 parts by weight.

The suspensions thus prepared were added to the dye solution employed for Sample D in example 1, well mixed and coated on an art paper sheet previously subjected to electroconductive treatment as in Example 1 to obtain a dried coating thickness of 10 microns. After drying, the coated paper was placed in a thermostatic box at 50° C for 16 hours to harden the resinous binder.

The photosensitive layers thus prepared (samples F, G and H) were developed with a liquid developer containing carbon black toner and then dipped for 30 seconds in bleaching bath of the following composition at 25° C:

Methyl alcohol — 300 ml
Ethyl alcohol — 300 ml
Acetone — 300 ml
n-butyl acetate — 100 ml
Potassium hydroxide — 10 gr.

The sensitizing dyes were exclusively removed from Samples F, G and H to provide reproductions with a black image on a background of pale yellow, pink and blue, respectively.

The photosensitive layers were then washed with methyl alcohol, dried and coated with the acrylic lacquer of Example 1 for surface protection to provide reproductions easily classifiable by background color.

In Example 3 exposure was with a tungsten through a transparency (illuminance : 100 lux., 1sec)

EXAMPLE 4

Samples B, C and D of Example 1, sample E of Example 2, and Samples F, G and H of Example 3 were each laminated with a plastic film provided with an adhesive material containing a peroxide. In samples B, C, D, and E, exposure to light for 5 hours provided results similar to those shown before, while samples F, G and H had an appearance similar to that explained in example 3 after light-exposure for about 2 hours.

The plastic film employed for laminating was polyethylene terephthalate provided with a layer of adhesive which was a terpolymer of ethyl acrylate, N-vinyl-2-pyrrolidone and N-tert-butylacrylamide (ethyl acrylate/N-vinyl-2-pyrrolidone/ N-tertiary-butylacrylamide = 55/20/25 (wt.ratio) intrinsic viscosity in acetone : 0.85 – 1.0) containing a small amount (0.02 wt.% based on the terpolymer resin) of tert-butyl hydroperoxide. Lamination was carried out by means of a heated roll.

EXAMPLE 5

Instead of the Sample D in Example 1, which was found to be unsuitable for multi-color reproduction because of its unbalanced spectral sensitivity under tungsten light the combinations of dyes set out below was employed. The photosensitive layer prepared was reddish in fresh state, but the reproduction background changed to a neutral color after light-exposure for 2 hours after coating with a lacquer containing peroxides.

In this example a dye solution of the following composition was added to 100 gr of zinc oxide.

Sample I

3-β-carboxyethyl-2(3,3-dicyanoallylidenebenzothiazole — 20 mg
Rose bengal — 10 mg
C.I. direct blue (C.I. 74180) — 5 mg
Methanol — 10 mg .

An ordinary electrophotographic process consisting of electrostatic charging, imagewise exposure and developing was repeated three times with exposures of a multi-color original image through blue, green and red filters, respectively. Development was carried out with a liquid developers containing a yellow pigment of the following formula:

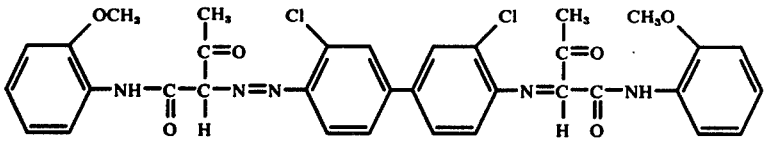

to obtain a yellow image, quinacridone magenta to obtain a magenta image and phthalocyanine blue to obtain a cyan image. After development, the photosensitive layers were coated with a transparent lacquer which contained polyisobutyl methacrylate as a non-volatile component and butyl acetate as a solvent which contained benzoyl peroxide in an amount of 0.1 wt.% (based on the non-volatile component).

According to this invention, it is thus possible to obtain an electrophotographic photosensitive material free from the drawbacks resulting from uneven spectral sensitivity upon repeated exposures which is capable of showing a neutral residual color after development.

EXAMPLE 6

The photosensitive layer shown in Example 2 was laminated with a polypropylene film provided with an adhesive layer consisting of 80 parts by weight of polybutyl methacrylate, 20 parts by weight of an aliphatic polyester (Japan Reichhold; D-tite 307 MH), 0.005 parts by weight of dicumyl peroxide and 0.005 parts by weight of benzoyl peroxide. Lamination was accomplished by passing the photosensitive sheet and the film between rolls heated to 70° C after the photosensitive sheet was developed with an isoparaffinic liquid developer containing carbon black toner and washed with an isoparaffinic solvent free of toner. The sheet was still wet with the solvent when lamination was conducted.

After lamination the photosensitive layer gradually changed color to show a final blue background.

What is claimed is:

1. A process for toning an electrophotographic layer comprising a photoconductive powdered material and a resinous binder which comprises adding at least two coloring materials to said layer, said coloring materials being selected from the group consisting of sensitizing dyes and pigments and mixtures thereof and having different fading rates in a succeeding bleaching process, forming a toner image on said electrophotographic layer, and selectively bleaching said sensitizing dyes after developing said layer so that one of said sensitizing dyes is bleached more than the other sensitizing dye or pigment, said other sensitizing dye or pigment being subjected to no further bleaching treatment to thereby tone said layer, said bleaching being conducted by applying a transparent lacquer containing at least 0.1 grams/meter$^2$ of a peroxide.

2. A process for toning an electrophotographic layer comprising a photoconductive powdered material and a resinous binder which comprises adding at least two coloring materials to said layer, said coloring materials being selected from the group consisting of sensitizing dyes and pigments and mixtures thereof and having different fading rates in a succeeding bleaching process, forming a toner image on said electrophotographic layer, and selectively bleaching said sensitizing dyes after developing said layer so that one of said sensitizing dyes is bleached more than the other sensitizing dye or pigment, said other sensitizing dye or pigment being subjected to no further bleaching treatment to thereby tone said layer, said bleaching being conducted by laminating a transparent plastic film on said electrophotographic layer using an adhesive which contains at least 1.0 grams/meter$^2$ of a peroxide.

3. A process as claimed in claim 2 wherein said adhesive is selected from a group consisting of a polyvinylacetate, a polyethylacrylate, a vinylacetate-ethylacrylate copolymer, a vinylacetate-ethylene copolymer, a polyethylhexymethacrylate, an aliphatic polyester, a xylene-formaldehyde resin, natural rubber, rosin, and a hydrogenated rosin.

4. A process as in claim 1 where the amount of said peroxide is within the range of 0.0001 – 0.1 grams/meter$^2$.

5. A process as in claim 4 where said range extends from 0.0001 – 0.01 grams/meter$^2$.

6. A process as in claim 2 where the amount of said peroxide is within the range of 0.0001 – grams/meter$^2$.

7. A process as in claim 6 where said range extends from 0.0001 – 0.01 grams/meter$^2$.

* * * * *